US005284124A

United States Patent [19]

Moriyama et al.

[11] Patent Number: 5,284,124

[45] Date of Patent: Feb. 8, 1994

[54] IGNITION SYSTEM FOR INTERNAL COMBUSTION ENGINE

[75] Inventors: Norio Moriyama, Ibaraki; Noboru Sugiura, Mito; Noriyoshi Urushiwara, Katsuta, all of Japan

[73] Assignee: Hitachi, Ltd., Tokyo, Japan

[21] Appl. No.: 950,703

[22] Filed: Sep. 25, 1992

[30] Foreign Application Priority Data

Sep. 26, 1991 [JP] Japan ..... 3-248001

[51] Int. Cl.[5] ..... F02P 3/12

[52] U.S. Cl. ..... 123/643; 123/630; 123/644

[58] Field of Search ..... 123/643, 644, 620, 605

[56] References Cited

U.S. PATENT DOCUMENTS

| | | | |
|---|---|---|---|
| 4,440,130 | 4/1984 | Taguchi et al. | 123/644 |
| 4,690,124 | 9/1987 | Higashiyama | 123/643 |
| 4,726,347 | 2/1988 | Sasaki et al. | 123/643 |
| 4,795,979 | 1/1989 | Kreft et al. | 123/643 |
| 4,836,176 | 6/1989 | Fujino et al. | 123/640 |
| 4,854,292 | 8/1989 | Urushiwara et al. | 123/630 |
| 4,881,512 | 11/1989 | Erskine et al. | 123/643 |
| 5,009,213 | 4/1991 | DiNunzio et al. | 123/620 |
| 5,033,445 | 7/1991 | Kobayashi et al. | 123/644 |
| 5,060,623 | 10/1991 | McCoy | 123/605 |

*Primary Examiner*—Raymond A. Nelli

*Attorney, Agent, or Firm*—Antonelli, Terry, Stout & Kraus

[57] ABSTRACT

An ignition system of electronic distribution type for an internal combustion engine with which merits of sharing circuits and elements can be expected with satisfactory result, in which wires of a GND line will not be disconnected by fusion even under a condition of abnormal power supply, and in which the engine will not be stalled even in a mode of simultaneously igniting two cylinders, thus enabling the limp-form traveling and made start-up with simultaneous ignition of two cylinders. To this end, power transistors 20 through 25 for power supply control and feedback control circuits 30 through 35 for limiting currents are respectively provided to control ignition coils 4 through 9 in one-to-one relation. A total of two systems of resistance devices 17*a*, 17*b* for detecting currents are provided with each resistance device operating a respective group of three cylinders. The feedback control circuits and the resistance devices for detecting currents are formed on a thick-film circuit board 60. Wires 50*a*, 50*b* used for connection between a GND portion on the thickfilm circuit board and an external GND terminal 50 are provided in the same number, i.e., two, as the number of resistance devices. The sequence of power distribution to the cylinders is determined, taking into account the fact that the resistance devices for detecting currents are each allocated to a respective group of three cylinders.

5 Claims, 3 Drawing Sheets

IGNITION SYSTEM FOR INTERNAL COMBUSTION ENGINE

BACKGROUND OF THE INVENTION

The present invention relates to an ignition system for internal combustion engines, and more particularly to an ignition system of the electronic distribution type for internal combustion engines, which is suitable for a multi-cylinder engine, such as a gasoline engine for automobiles, and in which an ignition plug is energized with a high voltage induced in a secondary coil when the current flowing through a primary coil of an ignition coil is cut off by a semiconductor switching device.

In multi-cylinder engines, such as gasoline engines for automobiles, by way of example, ignition systems of electronic distribution type have been recently introduced in which one ignition coil is provided for each one or pair of ignition plugs to perform ignition control without using a distributor.

Such an ignition system of the electronic distribution type requires a plurality of switching circuits which include power transistors and which carry out power supply control to conduct or cut off primary currents of the ignition coil, and a current detecting circuit which comprises a plurality of feedback control circuits for limiting currents so that the currents flowing through the ignition coils are controlled to a predetermined value, and resistance devices for detecting the currents. In this connection, attempts have been made at suppressing an increase in the cost by providing some control circuits and some circuit elements as shared devices by the use of plural ignition coils. One example of those attempts is disclosed in JP, A, 60-20667.

Also, JP, A, 3-43669 discloses a scheme in which it is proposed to achieve such common use for the same purpose. In this prior art arrangement, switching circuits and feedback control circuits are provided independently for all ignition coils, and only current detecting circuits are provided in common for every two successive circuits.

In the above-mentioned prior art arrangements, the feedback control circuits and the current detecting circuits are formed on a thick-film circuit board, and the ignition system is constituted in the form of a package. For this construction, a GND portion on the thick-film circuit board is connected to an external GND terminal by a single wire.

An ignition system of the electronic distribution type is used under thermally severe situations in the vicinity of an engine. Therefore, the wire used in the above-mentioned prior art arrangement to interconnect the GND portion on the thickfilm circuit board and the external GND terminal is formed into a predetermined shape to effectively absorb deformations due to repeated changes in temperature, and a nickel wire with a diameter of 0.3 mm is used in consideration of formability and elastic strength. The continuous withstand current of this wire is about 10 A. During operation of the ignition system, a current on the order of max. 8 A flows through the current detecting circuit. Accordingly, the wire of the GND line will not be disconnected by fusion and thus will function normally. However, it has been recently found that there are conditions in which the wire of the GND line may possibly be disconnected by fusion. Such a possibility is supposedly attributable to the following abnormal operation of the ignition system. Specifically, under certain conditions, the base current in the ignition system may be continuously kept in a HIGH state due to floating of the GND, noises, malfunction and other causes, which results in a condition of abnormal power supply wherein ignition coils for all cylinders cause ignition at the same time. In this event, the total current given by multiplying the current flowing through each current detecting resistance device by the number of the resistance devices flows through the wire of the GND line, causing the wire to be disconnected by fusion.

Furthermore, while the sequence of distribution is usually determined in ignition systems so as to ignite multiple cylinders one by one in sequence, two cylinders are simultaneously ignited in the limp-form traveling mode of operation. To surely start up the engine, a distribution method of simultaneously igniting two cylinders only at start-up may be employed in some cases. However, if such a mode of simultaneously igniting two cylinders is adopted in the above-mentioned prior systems, a current as large as twice the current flowing through the current detecting resistance device would flow through the wire of the GND line and the wire would be disconnected by fusion as with the foregoing event of abnormal operation. Accordingly, the mode of simultaneously igniting two cylinders cannot be adopted in the prior art.

SUMMARY OF THE INVENTION

An object of the present invention is to provide an ignition system for an internal combustion engine with which merits of sharing circuits and elements can be expected with satisfactory result, and wires of a GND line will not be disconnected by fusion even under a condition of abnormal power supply.

Another object of the present invention is to provide an ignition system for an internal combustion engine in which a mode of simultaneously igniting two cylinders can be adopted and, which can enable the limp-form traveling mode and realize more efficient start-up by simultaneous ignition of two cylinders.

To achieve the above objects, the present invention provides an ignition system for an internal combustion engine comprising a plurality of ignition coils and a power switching module to conduct or cut off primary currents of said ignition coils, said power switching module comprising a plurality of switching circuits for power supply control and a plurality of feedback control circuits for limiting currents corresponding to said ignition coils in one-to-one relation, and a plurality of current detecting circuits for said feedback control circuits, said feedback control circuits and said current detecting circuits being formed on a thick-film circuit board, wherein said current detecting circuits are provided so as to form of two control systems each controlling N/2 cylinders, where N is the number of cylinders of said engine, and the number of GND wires used for connection between a GND portion on said thick-film circuit board and an external GND terminal is two, which corresponds to the number of said current detecting circuits.

Also, the ignition system for the internal combustion engine of the present invention further comprises a controller for outputting an ignition control signal to each of the switching circuits of the power switching module. Preferably, the controller determines the distribution sequence so that power is alternately distributed to two groups of cylinders respectively associated with the two control systems of current detecting circuits.

As an alternative, preferably, the controller determines the distribution sequence so that, in a mode of simultaneously igniting two cylinders, power is distributed at the same time to two cylinders not belonging to the same group of cylinders respectively associated with the two control systems of current detecting circuits.

In the above ignition system for the internal combustion engine, preferably, the ignition coils and the power switching module are built in a single package, and the two GND wires are connected to a common GND portion on the thick-film circuit board incorporated in the single package. Depending on the cylinder number of the engine, the ignition coils and the power switching module may be divided into two packages, and the two GND wires may be connected to separate GND portions on two thick-film circuit boards incorporated in the two packages, respectively.

In accordance with the present invention, assuming that a limit value of the current flowing through either one of the current detecting circuits is on the order of max. 8 A, since currents flow through the two control systems of current detecting circuits under a condition where all the cylinders are ignited at the same time during abnormal operation, or under a condition of continuous power supply in the mode of simultaneously igniting two cylinders, the total current becomes max. 16 A. This current flows to a vehicle harness through the wires used for connection between the GND portion on the thick-film circuit board and the external GND terminal, and then to the ground of a vehicle body. When the wires are each formed of a nickel wire with a diameter of 0.3 mm like the prior art, the single wire has the continuous withstand current on the order of only about 10 A. In the present invention, however, the number of GND wires used for connection between the GND portion on the thick-film circuit board and the external GND terminal is two, which corresponds to the number of the current detecting circuits. As a result, the current flowing through one wire is on the order of max. 8 A and the wires will not be disconnected by fusion even under the condition of continuous power supply.

Additionally, in the present invention, the total two control systems of current detecting circuits are each provided for N/2 cylinders. In this case, assuming that the current limit value of each current detecting circuit is I A, the current flowing through the primary coil of each of the ignition coils in the event where all the cylinders are ignited at the same time becomes I/3 A for a 6-cylinder engine and I/4 A for an 8-cylinder engine. Specifically, given the current limit value of 8 A as mentioned above, a current of only 2.6 A flows per cylinder for a 6-cylinder engine. Therefore, if all the cylinders should be ignited at the same time under the condition of abnormal power supply, the current flowing through each secondary ignition coil is so small that the ignition coils can be prevented from producing fire or smoke.

Thus, the present invention can provide an ignition system for an internal combustion engine which is highly reliable from the two standpoints of preventing the wires of the GND line from being disconnected by fusion, and preventing the ignition coils from producing fire or smoke.

Furthermore, in the present invention, where engine cylinders are divided into two systems corresponding to the two systems of current detecting circuits, the distribution sequence is determined so that power is alternately distributed to the two systems of cylinders. For instance, when one control system of current detecting circuits (total of two) is provided for each group 1st - 2nd - 3rd cylinders and 4th - 5th - 6th cylinders in a 6-cylinder engine, one example of the ignition sequence is in the order of 1st - 5th - 3rd - 6th - 2nd - 4th cylinders.

Meanwhile, for the purpose of increasing energy given by an ignition coil, there are known a method of enlarging the primary current, another method of increasing the primary inductance, and a combination of both the methods. Among them, the method of increasing primary inductance requires the prolonging of a period of power supply necessary for reaching a predetermined current value, because rising of the primary current is delayed. In this case, when the engine rotates at a high speed, there may occur an overlap region where the power supply timing of one cylinder is partly overlapped with that of another cylinder. Even in the case of such overlap ignition, by determining the distribution sequence as mentioned above, the wires of the GND line will not be disconnected by fusion in any overlap regions. As a result, the overlap ignition can be practiced.

Moreover, in the mode of simultaneously igniting two cylinders, the present invention determines the distribution sequence so that power is distributed at the same time to those two cylinders not belonging to the same one of the two groups of cylinders respectively associated with the two control systems of current detecting circuits. In the case of an in-line 6-cylinder engine, for instance, two groups of 1st, 3rd and 5th cylinders and 2nd, 4th and 6th cylinders are each provided to be shared by one control system of current detecting circuits. Further, in the mode of simultaneously igniting two cylinders, the 1st and 4th cylinders, the 2nd and 5th cylinders, and the 3rd and 6th cylinders are ignited at the same time per pair, by way of example, so that the current corresponding to one cylinder is always surely caused to flow through only one current detecting circuit. Alternatively, in the case of a V-type 6-cylinder engine, three cylinders (1st, 3rd and 5th cylinders) on the left bank and other three cylinders (2nd, 4th and the 6th cylinders) on the right bank are thought of as separate groups in a like manner to the above case of an in-line serial 6-cylinder engine. In the mode of simultaneously igniting two cylinders, by igniting the 1st and 4th cylinders, the 3rd and 6th cylinders, and 5th and 2nd cylinders at the same time per pair, by way of example, the current corresponding to only one cylinder can be always surely caused to flow through only one current detecting circuit. It is thus possible to provide an ignition system for an internal combustion engine which is free from a reduction in the secondary voltage, disturbance in rotation of the engine, and stalling of the engine, and hence which is highly reliable. In addition, even if either one of the two current detecting circuits is broken, the engine can be operated by using only the remaining one to enable the limp-form traveling mode of engine operation.

DETAILED DESCRIPTION OF THE PREFERRED EMBODIMENTS

Hereinafter, an ignition system of the electronic distribution type for internal combustion engines according to the present invention will be described in connection with an illustrated embodiment.

Figure 1:
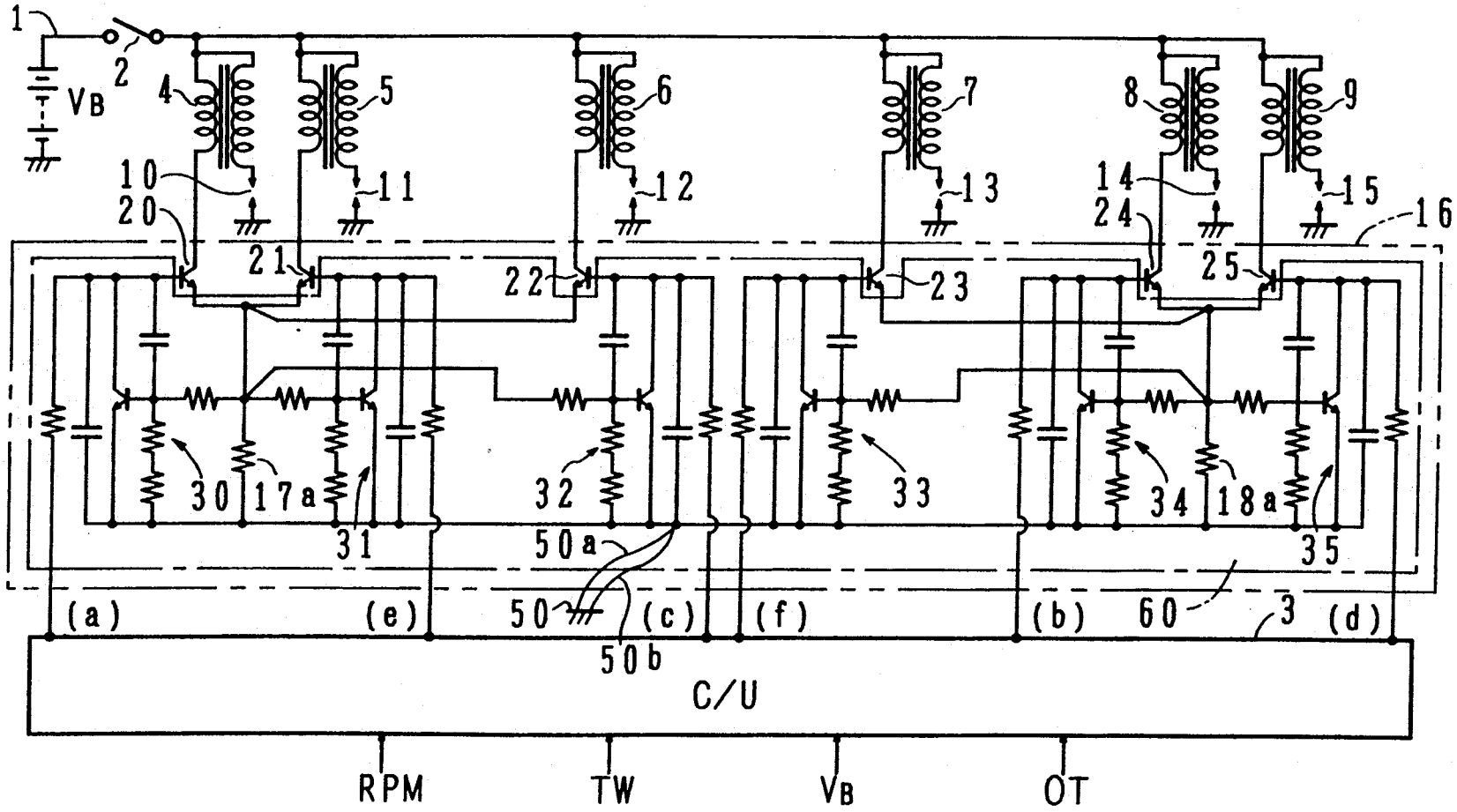
FIG. 1 is a circuit diagram of an ignition system for an internal combustion engine according to one embodiment of the present invention.

FIG. 1 shows one embodiment in which the present invention is applied to a in-line 6-cylinder gasoline engine. In the drawing, denoted by reference numerals 4 through 9 are six ignition coils corresponding to six ignition plugs 10 through 15 in one-to-one relation. A common terminal of the ignition coils is connected to a battery 1 via a key switch 2, while their secondary coils are directly connected to the corresponding ignition plugs 10 through 15.

In the above arrangement, the ignition plugs are associated with predetermined cylinders, respectively; i.e., the ignition plug 10 is associated with the first (1st) cylinder, the ignition plug 11 is associated with the second (2nd) cylinder, the ignition plug 12 is associated with the third (3rd) cylinder, the ignition plug 13 is associated with the fourth (4th) cylinder, the ignition plug 14 is associated with the fifth (5th) cylinder, and the ignition plug 15 is associated with the sixth (6th) cylinder. With such an arrangement, predetermined ignition control is carried out in the sequence of 1st cylinder - 5th cylinder - 3rd cylinder - 6th cylinder - 2nd cylinder - 4th cylinder, for instance.

Denoted by 16 is a power switching module incorporating six power transistors 20 through 25. These power transistors 20 through 25 have collectors connected to the primary coils of the ignition coils 4 through 9, respectively, and emitters serially connected to ground (GND) via resistance devices 17*a*, 18*a* for detecting currents. Those six power transistors 20 through 25 constitute six switching circuits for power supply control independently provided and corresponding to the ignition coils 4 through 9 in one-to-one relation. The power switching module 16 also includes six feedback control circuits 30 through 35 for limiting the amounts of currents supplied by the six switching circuits to a predetermined value, respectively. The resistance devices 17*a*, 18*a* for detecting currents constitute current detecting circuits for the feedback control circuits 30 through 35, and are respectively shared by the first three power transistors 20 through 22 and the second three powers transistors 23 through 25. Specifically, the resistance device 17*a* is commonly connected to the emitters of the power transistors 20 through 22 and the resistance device 18*a* is commonly connected to the emitters of the power transistors 23 through 25.

The feedback control circuits 30 through 35 and the current detecting circuits are formed on a thick-film circuit board 60. A GND portion on the thick-film circuit board 60 and an external GND terminal 50 are connected to each other by two wires 50*a*, 50*b* in the same number as the resistance devices 17*a*, 18*a* for detecting currents.

Denoted by reference numeral 3 is a controller comprising a microcomputer operated with voltage VB supplied from the battery 1 via the key switch 2 to take in various data indicative of operating status of the engine, such as a rotational speed RPM, cooling water temperature TW and throttle opening OT. The controller 3 produces predetermined ignition control signals (a) through (f) and inputs them to the power switching module 16, so that predetermined on/off signals are applied to bases of the power transistors 20 through 25.

Here, the controller 3 creates the control signals in such a manner that the ignition control is carried out in the sequence of 1st cylinder - 5th cylinder - 3rd cylinder - 6th cylinder - 2nd cylinder - 4th cylinder as mentioned above, i.e., that the power is alternately distributed to two systems of cylinders corresponding to the two systems of the resistance devices 17*a*, 18*a* for detecting currents. Also, the controller 3 creates the control signals in such a manner that, in a mode of simultaneously igniting two cylinders, the power is in pairs to two cylinders not belonging to the same system; for instance, 1st and 4th cylinders, 2nd and 5th cylinders, and 3rd and 6th cylinders.

In this embodiment, assuming that a limit value of the current flowing through either one of the resistance devices 17*a*, 18*a* for detecting currents is on the order of max. 8 A, since currents flow through both the resistance devices 17*a*, 18*a* for detecting currents under a condition where all the cylinders are ignited at the same time during abnormal operation, or under a condition of continuous power supply in the mode of simultaneously igniting two cylinders, the total current becomes max. 16 A. This current flows to a vehicle harness through the wires 50*a*, 50*b* used for connection between the GND portion on the thick-film circuit board 60 and the external GND terminal 50, and then to the ground of a vehicle body. When the wires 50*a*, 50*b* are each formed of a nickel wire with a diameter of 0.3 mm like the prior art, the single wire has a continuous withstand current on the order of only about 10 A. In this embodiment, however, because the two wires 50*a*, 50*b* are used for the two current detecting circuits, the current flowing through one wire is on the order of max. 8 A and, as a result, the wires will not be disconnected by fusion even under the condition of continuous power supply.

Additionally, in this embodiment, since a total of two systems of resistance devices 17*a*, 18*a* for detecting currents are each shared by the three cylinders, the current flowing through each primary coil of the ignition coils 4 through 9 in the event where all the cylinders are ignited at the same time is only 2.6 A per cylinder on an assumption that the current limit value of each resistance device for detecting current is 8 A as stated above. Therefore, if all the cylinders should be ignited at the same time under the condition of abnormal power supply, the current flowing through each secondary ignition coil is so small that the ignition coils 4 through 9 can be prevented from producing fire or smoke.

Consequently, with this embodiment, it is possible to provide an ignition system for internal combustion engines which is highly reliable from the two standpoints of preventing the wires of the GND line from being disconnected by fusion, and preventing the ignition coils from producing fire or smoke.

Meanwhile, for the purpose of increasing energy given by an ignition coil, there are known a method of enlarging the primary current, another method of increasing the primary inductance, and a combined one of both of these methods. The method of increasing primary inductance requires a prolonging of the period of the power supply necessary for reaching a predetermined current value, because the rising of the primary current is delayed. In this case, when the engine rotates at a high speed, there may occur an overlap region where the power supply timing of one cylinder is partly overlapped with that of another cylinder. Even in such overlap ignition, by determining the distribution sequence of 1st cylinder - 5th cylinder - 3rd cylinder - 6th cylinder - 2nd cylinder - 4th cylinder as mentioned above and carrying out the ignition control in accordance with this sequence, the wires of the GND line will not be disconnected by fusion in any overlap regions. As a result, the overlap ignition can be practiced without possibility of failure.

Moreover, in the mode of simultaneously igniting two cylinders, the 1st and 4th cylinders, the 2nd and 5th cylinders, and the 3rd and 6th cylinders are ignited at the same time per pair in this embodiment, so that the current corresponding to one cylinder is always surely caused to flow through only one current detecting circuit. It is thus possible to provide an ignition system for internal combustion engines which is free from a reduction in the secondary voltage, disturbance in rotation of the engine, and stalling of the engine, and hence which is highly reliable. In addition, even if either one of the two resistance devices 17*a*, 18*a* for detecting currents is broken, the engine can be operated by only the remaining one to enable the limp-form traveling mode of engine operation.

Figure 2:
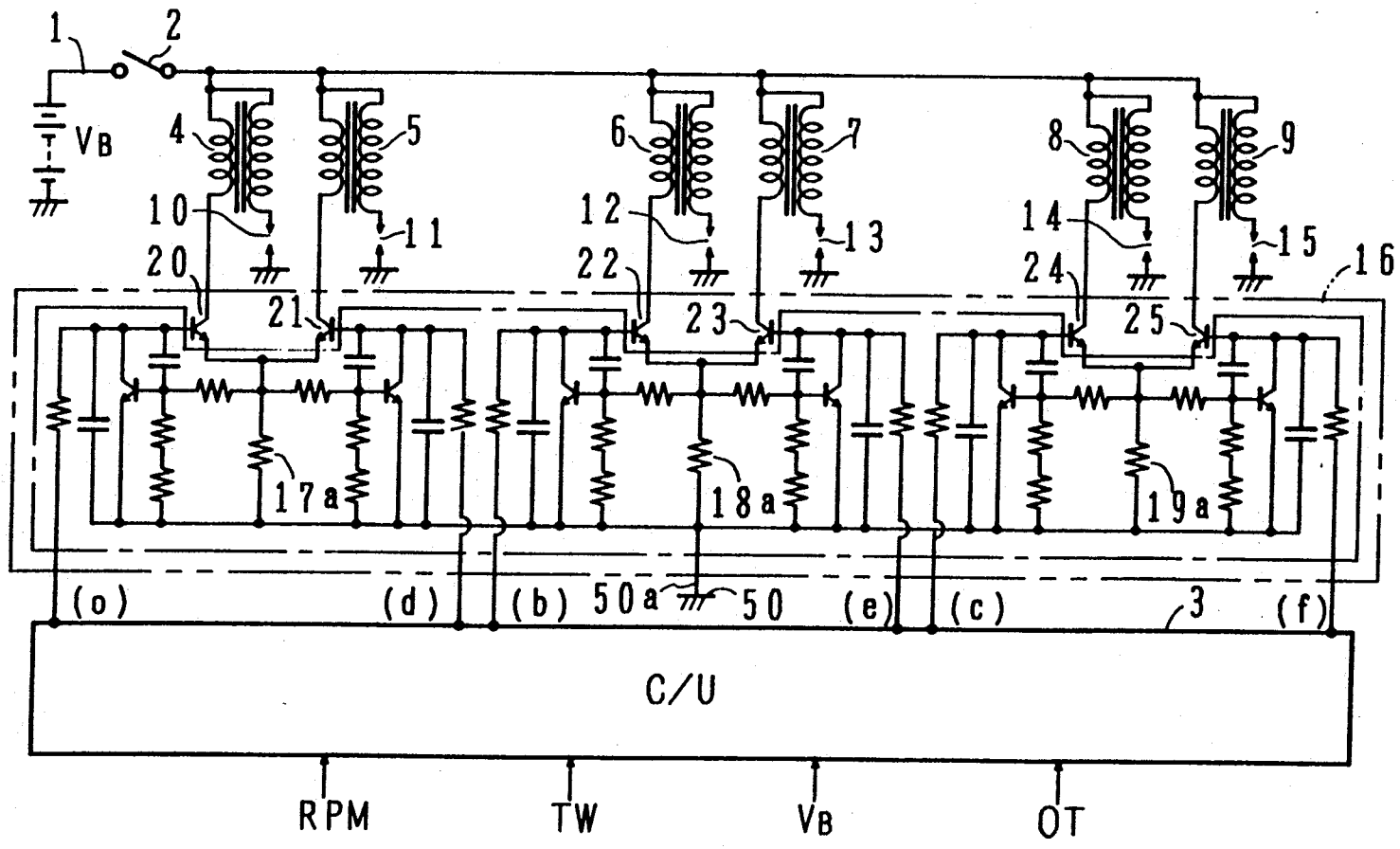
FIG. 2 PRIOR ART
FIG. 2 is a circuit diagram of the prior art.

FIG. 2 shows, for comparison, a conventional circuit as disclosed in the above-cited JP, A, 3-43669. In contrast with the embodiment of the present invention shown in FIG. 1, three resistance devices 17*a*, 18*a*, 19*a* for detecting currents are respectively shared by pairs of power transistors 20, 21; 22, 23; and 24, 25. Stated otherwise, because two circuits are shared by each resistance device for detecting current, the total of three resistance devices 17*a*, 18*a*, 19*a* for detecting currents are provided to deal with 6 channels for the six cylinders. A GND portion on the thick-film circuit board 60 and an external GND terminal 50 are connected to each other by a single wire 50*a*.

In this prior art circuit, since currents flow through the three resistance devices 17*a*, 18*a*, 19*a* for detecting currents under a condition where all the cylinders are ignited at the same time during abnormal operation, or under a condition of continuous power supply in the mode of simultaneously igniting two cylinders, the total current becomes max. 24 A with the specifications stated above, and the current flowing through the wire 50*a* also becomes max. 24 A. Therefore, if a conventional nickel wire with a diameter of 0.3 mm is used as the wire 50*a*, the wire 50*a* would be disconnected by fusion because the single wire has the continuous withstand current on the order of only about 10 A. Additionally, assuming that the current limit value of each of the resistance devices 17*a*, 18*a*, 19*a* for detecting currents is 8 A as stated above, the current flowing through each primary coil of the ignition coils 4 through 9 in the event where all the cylinders are ignited at the same time is 4 A per cylinder, meaning a greater possibility that the ignition coils 4 through 9 may produce fire or smoke, in comparison with the case of 2.6 A in the embodiment of the present invention. Consequently, the abovementioned advantages of the foregoing embodiment are not obtainable with the disclosed prior art.

Note that if the wire of the GND line were provided as three wires in the same number as the resistance devices for detecting currents in the disclosed prior art, the wires of the GND line could be prevented from being disconnected by fusion. However, with limitations on the shape and size of a package used to constitute the ignition system, it is difficult, from the standpoint of structure, to perform wiring of the three wires while meeting the limited shape and size, thus resulting in the reduced reliability. Also, it is impossible to prevent the ignition coils 4 through 9 from producing fire or smoke.

Figure 3:
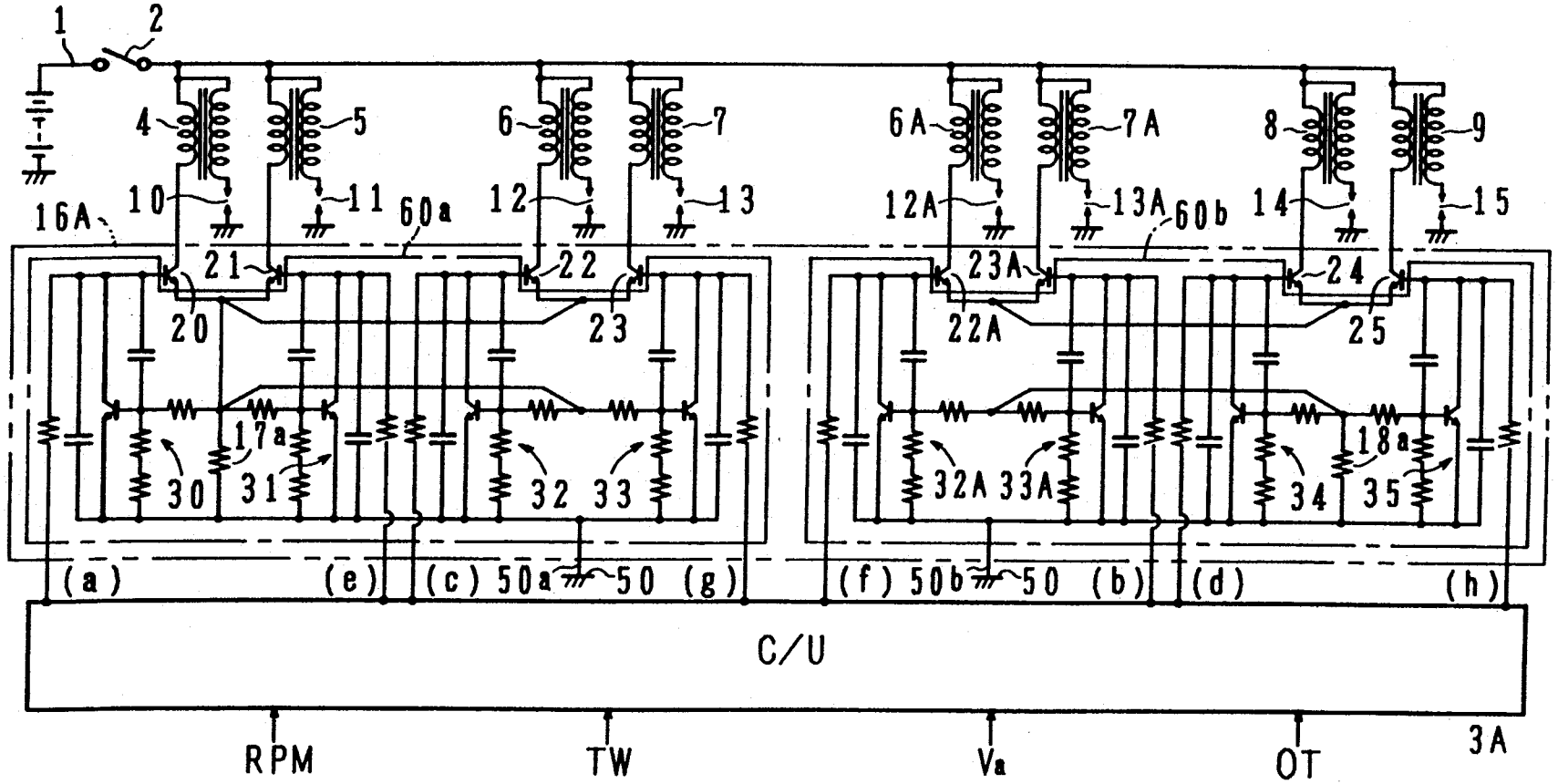
FIG. 3 is a circuit diagram of an ignition system for an internal combustion engine according to another embodiment of the present invention.

FIG. 3 shows an embodiment in which the present invention is applied to an 8-cylinder gasoline engine. This embodiment is different from the above embodiment shown in FIG. 1 relating to the 6-cylinder gasoline engine in that the ignition system is divided into two packages in conformity with the 8-cylinder engine construction. More specifically, eight ignition coils 4 through 9, 6A and 7A are provided corresponding to eight ignition plugs 10 through 15, 12A and 13A. The ignition coils 4 through 9, 6A and 7A and a power switching module 16A are divided into two packages. In each package, one resistance device 17*a* or 18*a* for detecting current is provided to be shared by four power transistors 20 through 23 or 22A, 23A, 24, 25, and a GND portion on a thick-film circuit board 60*a* or 60*b* is connected to an external GND terminal 50 by a single wire 50*a* or 50*b*. Denoted by 30 through 35, 32A and 33A are eight feedback circuits for limiting currents. A controller 3A creates predetermined ignition control signals (a) through (h) and applies them to the power switching module 16A. With this embodiment, there can be obtained similar advantages to those in the foregoing embodiment.

As has been described above, according to the present invention, even under a condition where all the cylinders are ignited at the same time during abnormal power supply, the wires used for connection between the GND portion on the thick-film circuit board and the external GND terminal will not be disconnected by fusion, and the current flowing through each secondary ignition coil is so small as to prevent the ignition coil from producing fire or smoke. A highly reliable ignition system for internal combustion engines can be thus provided.

Also, since the overlap ignition is enabled in which two cylinders are partly overlapped in power supply timing with each other, it is possible to prolong a period of power supply so that primary inductance may be increased to enlarge energy given by the ignition coils.

Further, with the sequence of power distribution to the cylinders taken into account, the secondary voltage will never be insufficient in a mode of simultaneously igniting two cylinders, as required in the limp-form traveling made or at start-up of the engine. Additionally, even if either one of the two resistance devices for detecting currents is broken and unable to perform its function, the engine can be operated without stalling by using only the remaining resistance device and, therefore, the limp-form traveling mode is enabled.

What is claimed is:

1. In an ignition system for an internal combustion engine having a plurality of ignition coils and a power switching module connected to said ignition coils to control the switching of primary currents of said ignition coils, said power switching module comprising:

a number of switching circuits for power supply control corresponding in number to the number of said ignition coils, and a plurality of current detecting circuits connected to said switching circuits, said switching circuits and said current detecting circuits being formed on a thickfilm circuit board having a ground (GND) portion formed thereon with said current detecting circuits being connected to said GND portion;

wherein two current detecting circuits are provided respectively to form with said switching circuits a total of two control systems which each control the ignition coils of N/2 cylinders, in which N is the number of cylinders of said engine, and two GND wires are connected in parallel to said GND portion on said thick-film circuit board for connection to an external GND terminal, so as to limit the maximum current carried by each of said GND wires.

2. An ignition system for an internal combustion engine according to claim 1, further comprising a controller for outputting an ignition control signal to each of said switching circuits of said power switching module, said controller including means for determining the ignition sequence of said ignition coils so that power is alternately distributed to two groups of cylinders respectively associated with said two control systems of current detecting circuits.

3. An ignition system for an internal combustion engine according to claim 1, further comprising a controller for outputting an ignition control signal to each of said switching circuits of said power switching module, said controller determining the distribution sequence so that, in a mode of simultaneously igniting two cylinders, power is distributed at the same time to two cylinders not belonging to the same one of the two groups of cylinders respectively associated with said two control systems of current detecting circuits.

4. An ignition system for an internal combustion engine according to claim 1, wherein said ignition coils and said power switching module are built in a single package, and said two GND wires are connected to a common GND portion on said thick-film circuit board incorporated in said single package.

5. An ignition system for an internal combustion engine according to claim 1, wherein said ignition coils and said power switching module are divided into two packages, and said two GND wires are connected to separate GND portions on two thick-film circuit boards incorporated in said two packages, respectively.

* * * * *